United States Patent [19]

Utsumi

[11] Patent Number: 4,977,020

[45] Date of Patent: Dec. 11, 1990

[54] TRANSFER MATERIAL FOR USE WITH PRINTER

[75] Inventor: Shigeo Utsumi, Yamato, Japan

[73] Assignee: Diafoil Company, Ltd., Tokyo, Japan

[21] Appl. No.: 398,396

[22] Filed: Aug. 25, 1989

[30] Foreign Application Priority Data

Aug. 31, 1988 [JP] Japan ..... 63-216762

[51] Int. Cl.[5] ..... B41M 5/26

[52] U.S. Cl. ..... 428/323; 428/141; 428/336; 428/409; 428/480; 428/913; 428/914

[58] Field of Search ..... 8/471; 503/227; 428/195, 204, 480, 484, 488.1, 910, 913, 914, 141, 323, 336, 409

[56] References Cited

FOREIGN PATENT DOCUMENTS 222374 5/1987 European Pat. Off. ..... 428/913

*Primary Examiner*—Pamela R. Schwartz

*Attorney, Agent, or Firm*—Oblon, Spivak, McClelland, Maier & Neustadt

[57] ABSTRACT

Disclosed herein is a transfer material for use with a printer, which comprises a biaxially oriented polyester film which simultaneously satisfies the following expressions (I) to (III):

$$12.0 \leqq F_5 \leqq 17.0 \quad \text{(I)}$$

$$\sigma \leqq 0.06 \times F_5 - 0.5 \quad \text{(II)}$$

$$E_p \geqq 4 \times 10^3 \times \Delta n_p + 250 \quad \text{(III)}$$

wherein $F_5$ represents the $F_5$ value (kg/mm$^2$) in the machine direction of said polyester film, $\sigma$ represents a heat shrinkage (%) in the machine direction of said polyester film after heat treatment at 100° C. for 30 minutes, $E_p$ represents a Young's modulus (kg/mm$^2$) in the machine direction, and $\Delta n_p$ represents a degree of plane orientation of said polyester film, and a transfer ink layer formed on one surface or both surfaces of said polyester film.

The transfer material according to the present invention is of great value in industry because the transfer material is excellent in durability and free from problems such as longitudinal tear and plastic strain. Also, the transfer material of the present invention has a capability of reducing the thickness without impairing the printing property thereof.

6 Claims, No Drawings

TRANSFER MATERIAL FOR USE WITH PRINTER

BACKGROUND OF THE INVENTION

The present invention relates to a transfer material used in a printer, and more particularly to a transfer material for use in a type writer or a thermal printer and exhibiting an excellent dimensional stability and durability.

A polyester film has been used as the base of a transfer material used in a printer because of its high crystallizability, high melting point, and improved heat resistance, chemicals resistance, strength, and elasticity. The transfer material for use in a dot impact type printer needs to have durability of the level to withstand the tension or printing pressure applied to the transferring ribbon for the purpose of using it repeatedly. The transfer material for use in a thermal printer needs to have improved strength, heat resistance, and dimensional stability since the thickness of the base film thereof has been reduced recently.

However, the usual biaxially oriented polyester film of the type disclosed in Japanese Patent Laid-Open (KOKAI) No. 60-217194 for use as the base film encounters a problem of elongation of the film or plastic strain during the transferring operation. Therefore, the biaxially oriented polyester film has not been satisfactorily used as the transferring ribbon of the type to which high tension and high printing pressure is involved to be applied.

That is, when the strength of the film is strengthened in order to reduce the thickness of the film, the thus-strengthened film can be easily torn longitudinally. In a thermal printer, such a thin film cannot be used as a transfer material due to its excessive heat shrinking. Therefore, it has been difficult to reduce the thickness.

The inventor has studied in order to overcome the above-described problems and found that a transfer material in which a polyester film having a specific characteristic is employed can overcome the problems. The present invention has accomplished based on this finding.

SUMMARY OF THE INVENTION

In a first aspect of the present invention, there is provided a transfer material for use with a printer comprising a biaxially oriented polyester film which simultaneously satisfies the following expressions (I) to (III):

$$12.0 \leqq F_5 \leqq 17.0 \quad \text{(I)}$$

$$\sigma \leqq 0.06 \times F_5 - 0.5 \quad \text{(II)}$$

$$E_p \geqq 4 \times 10^3 \times \Delta n_p + 250 \quad \text{(III)}$$

wherein $F_5$ represents the $F_5$ value (kg/mm$^2$) of said polyester film in the machine direction, $\sigma$ represents a heat shrinkage (%) of said polyester film in the machine direction after heat treatment at 100° C. for 30 minutes, Ep represents a Young's modulus (kg/mm$^2$) of said polyester film in the machine direction, and $\Delta n_p$ represents a degree of plane orientation of said polyester film, and a transfer ink layer formed on both surfaces or one surface of said polyester film.

In a second aspect of the present invention, there is provided a process for producing the transfer material used in printer as defined above.

DETAILED DESCRIPTION OF THE INVENTION

The polyester used in the present invention includes known polyesters, preferably polyethylene terephthalate, copolyester comprising ethylene terephthalate unit as the main constitutional repeating unit and a polymer blend containing polyethylene terephthalate or the copolyester as the main component. Of the copolyesters, preferred are those in which 80 mol% or more of the acid component is the terephthalate unit and 80 mol% or more of the glycol component is the ethylene glycol unit. As the polymer blend, preferred are those in which 80 wt% or more of the blend is polyethylene terephthalate or the copolyester as defined above and 20 wt% or less of the blend is other polymer. The polyester used in the present invention may contain, if necessary, a stabilizer, a coloring material, an antioxidant, a lubricant, or other additives.

The polyester film according to the present invention is prepared by biaxially stretching an amorphous sheet made from a composition comprising the above-described polyester. The $F_5$ value of the polyester film in the machine direction is 12 to 17 kg/mm$^2$, preferably 13 to 17 kg/mm$^2$, further preferably 14 to 17 kg/mm$^2$.

If $F_5$ is less than 12 kg/mm$^2$, plastic strain can be generated in the printing portion of the film since an elongation of the film which cannot be elastically recovered can be easily generated. Therefore, the thickness of the film cannot be reduced effectively. On the other hand, if the $F_5$ value exceeds 17 kg/mm$^2$, the film can be easily torn by printing pressure due to the strengthened rigidity, and causing the print obtained by the thermal transfer becomes unclear due to a higher shrinkage of the film.

It is necessary for the polyester film according to the present invention that the relationship between the $F_5$ value (kg/mm$^2$) in the machine direction and heat shrinkage $\sigma$ (%) in the machine direction after heat treatment at 100° C. for 30 minutes satisfies the following expression (II):

$$\sigma \leqq 0.06 \times F_5 - 0.5 \quad \text{(II)}$$

If the polyester film does not satisfy the above expression, its heat shrinkage becomes too increased for the film to be thinned.

Furthermore, it is necessary for the relationship between the degree of plane orientation $\Delta n_p$ which is defined in the following expression (IV) and Young's modulus $E_p$ (kg/mm$^2$) in the machine direction of the film to satisfy the following expression (III):

$$E_p \geqq 4 \times 10^3 \times \Delta n_p + 250 \quad \text{(III)}$$

$$\Delta n_p = n_{MD} - \frac{n_{TD} + n_\alpha}{2} \quad \text{(IV)}$$

wherein $n_{MD}$, $n_{TD}$, and $n_\alpha$ represent the refractive index in the machine direction of the film, the refractive index in the transverse direction of the film, and the refractive index in the thickness direction of the film, respectively.

If the Young's modulus does not satisfy the expression (III) above, a problem of elongation of the film due to the printing pressure arises.

It is preferable that roughness units composed of a minute protrusion and a recess therearound having a longer diameter of at least 3 μm are present on the surface of the polyester film, the number A (the number of units/mm$^2$) of the roughness units per the film surface area mm$^2$ being 10000 units or less, preferably 4000 units or less.

It is preferable that the average refractive index $\bar{n}$ (the average of $n_{MD}$, $n_{TD}$, and $n_a$) is 1.604 to 1.610.

It is preferable that the thickness of the polyester film according to the present invention is 1 to 6 μm, preferably 1 to 4 μm. If the thickness of the film exceeds 6 μm, heat conduction takes an excessively long time. Therefore, it cannot be suitably used in the high speed printing. On the contrary, if it is thinner than 1 μm, the obtainable strength is not sufficient in processability.

The average surface roughness of the polyester film according to the present invention is 0.02 to 1 μm in terms of the center line average surface roughness, preferably 0.02 to 0.8 μm. The above-described preferred surface roughness can be obtained by properly employing the conventional methods such as addition of inorganic particles, addition of organic particles, a sandmat method, a chemical treatment method, and a coating mat method. It is preferable that the rough surface is formed by a method in which inorganic particles having average particle size of 0.02 to 20 μm are contained in the film by 0.05 to 5 wt%.

The transfer material according to the present invention is produced, for example, by the following method.

First, polyester or a polyester blend is melted and extruded in the form of sheet from a slit-shape die. The thus extruded sheet is then cooled down on a casting drum at a temperature from $T_g$ (glass transition temperature of polyester) − 30 to $T_g$ + 30° C. to obtain an amorphous sheet. The thus obtained sheet is subjected to a multi-stage machine direction stretching at a higher temperature and in a higher stretch ratio, that is, the sheet is subjected to a multi-stage stretching at a plurality of stages, usually 2 to 4 stages, under a condition of 100° to 300° C. and the total stretch ratio of 3.0 times or greater, preferably 4.0 to 7.0 times. It is preferable that each of stretched films from each stage of the multi-stage stretching is transferred into the next stretching stage of the multi-stage stretching without being cooled down to a temperature of $T_g$ or below.

The film subjected to the multi-stage stretching may be, if necessary, subjected to further stretching in the machine direction in a stretch ratio of 1.1 to 3.0 times at a temperature of 90° to 115 ° C., after being cooled down to a temperature of $T_g$ or below.

The thus obtained film is then stretched in the transverse direction in a stretch ratio of 3.0 to 4.5 times the original length at a temperature of 100° to 145 ° C., preferably 120° to 135 ° C. without cooling the film to a temperature of $T_g$ or below.

Then, the thus biaxially stretched film is subjected to heat treatment at a temperature of 200° to 240° C. for 1 to 300 sec.

The heat treated film is then subjected to relaxation in the transverse direction by 2 to 10% at a temperature of 180° to 250° C. in a heat treatment zone and then in the machine direction by 2 to 10% at a temperature of 100° to 200° C., and subjected to cooling down process and winding process. Thus, the biaxially oriented polyester film according to the present invention is obtained.

Then, a transfer ink layer is formed on the thus-obtained biaxially oriented polyester film. This biaxially orientated polyester film may be subjected to a corona discharge treatment or undercoating treatment if necessary.

The transfer ink may be selected from conventional transfer inks without any particular limitation. Specifically, the transfer ink contains a binder component and a coloring component as its main component and a softening agent, a flexibilizer, a melting point adjusting agent, a smoothener, or a dispersant as additives to be added according to necessity.

As the binder component, conventional wax such as paraffin wax, carnauba wax, and ester wax or various high polymers of low melting point can be preferably used. As the component for the coloring agent, carbon black, organic or inorganic pigments and dyes can be preferably used. The ink may include a sublimation type.

As the method to form the transfer ink layer on one or both side of the biaxially orientated polyester film, conventional methods can be employed. For example, a hot-melt coating and a liquid coating such as a glavure method, a reverse method and a slit die method in case of using a solvent may be employed.

When the transfer material is used for the thermal transfer printer, an anti-fusing layer may be formed on the surface of the film on which no transfer ink layer is formed in order to prevent stickings of the film to the thermal head.

The present invention will be explained more in detail referring the following non-limitative Examples.

The evaluation of the physical properties of the film is made as follows:

(1) $F_5$ value

A sample film of ½-inch width was pulled under a condition of chuck distance of 50 mm, 20° C., 65%Rh, and pulling rate of 50 mm/min by Tensilon (UTN-III) manufactured by Toyo Boldwin Co., Ltd. The load at 5% elongation was divided by the cross sectional area of the original film. The thus-calculated results were expressed in a kg/mm$^2$ unit.

(2) Heat Shrinkage $\sigma$

It was measured after allowing the sample film to stand in an oven at 100° C. for 30 minutes without any tension applied. It was obtained from the following equation assuming that the original length was Lo and the length after the heat treatment was L:

$$\textit{Heat Shrinkage } \sigma(\%) = (Lo - L)/Lo \times 100$$

(3) Refractive Index

Refractive indices of the film in the machine direction, transverse direction, and the thickness direction were measured at a room temperature and normal pressure by using an Abbe's refractometer and an Na-D line.

(4) Surface roughness

It was measured in accordance with JIS B-0601.

(5) The number (A) of the roughness unit composed of a minute protrusion and a recess around the protrusion.

The surface of a aluminum deposited film was photographed by 750 magnification with a differential interferential-microscope manufactured by Karl Zwies Co., Ltd. The number of the protrusions present in 1 mm$^2$ area of the film surface area was counted.

EXAMPLES 1 to 3

Polyethylene telephthalate having an intrinsic viscosity of 0.63 and containing 2.1 wt% of silicon dioxide having an average particle size of 1.0 μm and 0.4 wt% of calcium carbonate having an average particle size of 1.3 μm was melt-extruded through a 0.8 mm slit by using an extruder and a T-die into a sheet form. The thus-extruded sheet was wound on a casting drum maintained at a surface temperature of 75° C. Then, the sheet was solidified so that the temperature of the sheet might not lowered below Tg. Then, the sheet was subjected to a first stage stretching by 2.0 times by the roll so heated that the temperature of the film was raised to 125° C. The thus-stretched film was, without being subjected to any cooling, subjected to a second stage stretching by 3.0 times at 105° C. Then, it was cooled down to a temperature of Tg or below, and was subjected to a third stage stretching by 1.2 times in the machine direction at 97° C. Then, it was subjected to a transverse stretching at 130° C. by 3.8 times without being cooled to a temperature of Tg or below. The thus-obtained biaxially stretched film was heat-set at 230° C., and was relaxed by 5% in the transverse direction at the maximum temperature of heat treatment zone. Then, it was subjected to a 3% relaxation in the machine direction to obtain a biaxially oriented film having a thickness of 4 μm.

On the other hand, other film were obtained by a method similar to that employed in Example 1 except that the stretch ratio at the third stage was 1.3 times (Example 2), and 1.4 times (Example 3).

The characteristics of the thus-obtained films were measured. The results are shown in Table 1.

COMPARATIVE EXAMPLE 1

The same starting material as used in Example 1 was melt-extruded by using an extruder and T-die. The extruded material was cooled and solidified by closely contacting on a water cooling drum to obtain a non-stretched sheet.

The non-stretched sheet was preheated to 80° C., then, subjected to a first stage stretching in the machine direction by 1.9 times at a temperature of 110° C. and a second stage stretching by 2.4 times at a temperature of 115° C. The stretched film was then stretched in the transverse direction by 3.5 times at a temperature of 110° C. in a tenter oven. The biaxially stretched film was further stretched in the machine direction by 1.02 times at a temperature of 100° C., subjected to heat treatment at a temperature of 220° C., cooled down, and finally wound up.

The characteristics of the thus obtained film are shown in Table 1.

On the surface of the film respectively obtained in Examples 1 to 3 and Comparative Example 1, a transfer ink layer of the following composition:

| | |
|---|---|
| carnauba wax | 30 wt % |
| ester wax | 35 wt % |
| carbon black | 12 wt % |
| polytetrahydrofuran | 10 wt % |
| silicon oil | 3 wt % |

was formed by hot-melt coating method with heated roll so as to make the thickness thereof 5 μm to obtain a transfer material.

The thus-obtained transfer materials were subjected to a printing test by using a dot impact printer and a thermal transfer type printer. In comparison to the transfer materials according to the comparative example, the transfer materials made from the films according to the Examples 1 to 3, in particular the transfer material made from the film according to the Example 3 gave extremely excellent printing.

TABLE 1

| | Example 1 | Example 2 | Example 3 | Comparative Example 1 |
|---|---|---|---|---|
| Thickness (μm) | 4.0 | 4.0 | 4.0 | 4.0 |
| $F_5$ value (kg/mm$^2$) in the machine direction | 12.2 | 13.8 | 14.6 | 11.8 |
| Shrinkage in the machine direction (%) | 0.10 | 0.18 | 0.22 | 0.50 |
| $\Delta n_p \times 10^3$ | 75.0 | 80.2 | 83.5 | 80.1 |
| Ra (μm) | 0.023 | 0.022 | 0.020 | 0.023 |
| Young's modulus (kg/mm$^2$) in the machine direction | 570 | 600 | 640 | 480 |
| The number of roughness unit (units/mm$^2$) | 2800 | 1400 | 600 | 6000 |
| n | 1.6052 | 1.6051 | 1.6050 | 1.6032 |

What is claimed is:

1. A transfer material for use with a printer, which comprises a biaxially oriented polyethylene terephthalate film which simultaneously satisfies the following expressions (I) to (III):

$$12.0 \leqq F_5 \leqq 17.0 \quad \text{(I)}$$

$$\sigma \leqq 0.06 \times F_5 - 0.5 \quad \text{(II)}$$

$$E_p \geqq 4 \times 10^3 \times \Delta n_p + 250 \quad \text{(III)}$$

wherein $F_5$ represents the $F_5$ value (kg/mm$^2$) in the machine direction of said polyester film, $\sigma$ represents a heat shrinkage (%) in the machine direction of said polyester film after heat treatment at 100° C. for 30 minutes, $E_p$ represents a Young's modulus (kg/mm$^2$) in the machine direction, and $n_p$ represents a degree of plane orientation of said polyester film and is defined by the expression (IV):

$$\Delta n_p = n_{MD} - \frac{n_{TD} + n_\alpha}{2}$$

wherein $n_{MD}$, $n_{TD}$, and $n\alpha$ represent the refractive index in the machine direction of the film, the refractive index in the transverse direction of the film, and the refractive index in the thickness of the film, respectively, and a transfer ink layer formed on one surface or both surfaces of said polyester film.

2. The transfer material according to claim 1, wherein the center line average surface roughness of said polyester film is 0.02 to 1 μm.

3. The transfer material according to claim 1, wherein the polyethylene terephthalate film has a thickness ranging from 1 to 6 μm.

4. The transfer material according to claim 3, wherein said thickness ranges from 1 to 4 μm.

5. The transfer material according to claim 1, wherein said polyethylene terephthalate film has a surface roughness which is imparted to the film by the incorporation of from 0.05 to 5 wt% of inorganic particles having an average particle size of 0.02 to 20 μm in the polyethylene terephthalate.

6. The transfer material according to claim 1, wherein said polyethylene terephthalate film has a roughness such that the number of roughness units present on the surface of the film is 10,000 or less per film surface area of 1 mm$^2$, said roughness units each being composed of a minute protrusion and a recess there around having a diameter longer than at least 3 μm.

* * * * *